US008714232B2

(12) United States Patent
Hanna et al.

(10) Patent No.: US 8,714,232 B2
(45) Date of Patent: May 6, 2014

(54) METHOD OF MAKING A BRAKE COMPONENT

(75) Inventors: Michael D. Hanna, West Bloomfield, MI (US); Mohan Sundar, Troy, MI (US); Rao Mallikarjuna Chalasani, Bangalore (IN)

(73) Assignee: GM Global Technology Operations LLC, Detroit, MI (US)

( * ) Notice: Subject to any disclaimer, the term of this patent is extended or adjusted under 35 U.S.C. 154(b) by 93 days.

(21) Appl. No.: 12/885,813

(22) Filed: Sep. 20, 2010

(65) Prior Publication Data

US 2012/0067537 A1 Mar. 22, 2012

(51) Int. Cl.
*B22D 19/00* (2006.01)
*B22D 19/02* (2006.01)

(52) U.S. Cl.
USPC ..... 164/98; 164/112

(58) Field of Classification Search
USPC ..... 164/98, 106, 107, 108, 112
See application file for complete search history.

(56) References Cited

U.S. PATENT DOCUMENTS

| | | | |
|---|---|---|---|
| 974,024 | A | 10/1910 | Carter |
| 1,484,421 | A | 2/1924 | Thomspon |
| 1,989,211 | A | 1/1935 | Norton |
| 2,012,838 | A | 8/1935 | Tilden |
| 2,026,878 | A | 1/1936 | Farr |
| 2,288,438 | A | 6/1942 | Dach |
| 2,603,316 | A | 7/1952 | Pierce |
| 2,978,793 | A | 4/1961 | Lamson et al. |
| 3,085,391 | A | 4/1963 | Hatfield et al. |
| 3,127,959 | A | 4/1964 | Wengrowski |
| 3,147,828 | A | 9/1964 | Hunsaker |
| 3,292,746 | A | 12/1966 | Robinette |
| 3,378,115 | A | 4/1968 | Stephens, III |
| 3,425,523 | A | 2/1969 | Robinette |
| 3,475,634 | A | 10/1969 | Bogdanov et al. |
| 3,509,973 | A | 5/1970 | Kimata |
| 3,575,270 | A | 4/1971 | Wagenfuhrer et al. |
| 3,774,472 | A | 11/1973 | Mitchell |
| 3,841,448 | A | 10/1974 | Norton, Jr. |
| 3,975,894 | A | 8/1976 | Suzuki |
| 4,049,085 | A | 9/1977 | Blunier |
| 4,072,219 | A | 2/1978 | Hahm et al. |

(Continued)

FOREIGN PATENT DOCUMENTS

| | | | |
|---|---|---|---|
| CH | 428319 | A | 1/1967 |
| CN | 20051113784 | A | 10/2005 |

(Continued)

OTHER PUBLICATIONS

Anyalebechi, P.N.; "Undulatory Solid Shell Growth of Aluminum Alloy 3003 . . . "; Materials Processing Fundamentals, TMS, 2007, pp. 31-45.

(Continued)

*Primary Examiner* — Kevin P Kerns
(74) *Attorney, Agent, or Firm* — BrooksGroup

(57) ABSTRACT

One exemplary embodiment includes a method that calls for supporting an insert in a mold cavity of a casting die by way of one or more spacers, introducing a molten material into the mold cavity such that the one or more spacers are melted and consumed by the molten material, and wherein the one or more spacers and the molten material are of the same composition.

32 Claims, 3 Drawing Sheets

(56) References Cited

U.S. PATENT DOCUMENTS

| | | | |
|---|---|---|---|
| 4,195,713 | A | 4/1980 | Hagbjer et al. |
| 4,250,950 | A | 2/1981 | Buxmann et al. |
| 4,278,153 | A | 7/1981 | Venkatu |
| 4,338,758 | A | 7/1982 | Hagbjer |
| 4,379,501 | A | 4/1983 | Hagiwara et al. |
| 4,523,666 | A | 6/1985 | Murray |
| 4,529,079 | A | 7/1985 | Albertson |
| 5,004,078 | A | 4/1991 | Oono et al. |
| 5,025,547 | A | 6/1991 | Sheu et al. |
| 5,083,643 | A | 1/1992 | Hummel et al. |
| 5,115,891 | A | 5/1992 | Raitzer et al. |
| 5,139,117 | A | 8/1992 | Melinat |
| 5,143,184 | A | 9/1992 | Snyder et al. |
| 5,184,663 | A | 2/1993 | Oono |
| 5,259,486 | A | 11/1993 | Deane |
| 5,310,025 | A | 5/1994 | Anderson |
| 5,416,962 | A | 5/1995 | Passarella |
| 5,417,313 | A | 5/1995 | Matsuzaki et al. |
| 5,509,510 | A | 4/1996 | Ihm |
| 5,539,213 | A | 7/1996 | Meeks et al. |
| 5,582,231 | A | 12/1996 | Siak et al. |
| 5,620,042 | A | 4/1997 | Ihm |
| 5,660,251 | A | 8/1997 | Nishizawa et al. |
| 5,789,066 | A | 8/1998 | De Mare et al. |
| 5,819,882 | A | 10/1998 | Reynolds et al. |
| 5,855,257 | A | 1/1999 | Wickert et al. |
| 5,862,892 | A | 1/1999 | Conley |
| 5,878,843 | A | 3/1999 | Saum |
| 5,927,447 | A | 7/1999 | Dickerson |
| 5,965,249 | A | 10/1999 | Sutton et al. |
| 6,047,794 | A | 4/2000 | Nishizawa |
| 6,073,735 | A | 6/2000 | Botsch |
| 6,112,865 | A | 9/2000 | Wickert et al. |
| 6,206,150 | B1 | 3/2001 | Hill |
| 6,216,827 | B1 | 4/2001 | Ichiba et al. |
| 6,223,866 | B1 | 5/2001 | Giacomazza |
| 6,231,456 | B1 | 5/2001 | Rennie et al. |
| 6,241,055 | B1 | 6/2001 | Daudi |
| 6,241,056 | B1 | 6/2001 | Cullen et al. |
| 6,283,258 | B1 | 9/2001 | Chen et al. |
| 6,302,246 | B1 | 10/2001 | Naumann et al. |
| 6,357,557 | B1 | 3/2002 | Di Ponio |
| 6,405,839 | B1 | 6/2002 | Ballinger et al. |
| 6,465,110 | B1 | 10/2002 | Boss et al. |
| 6,481,545 | B1 | 11/2002 | Yano et al. |
| 6,505,716 | B1 | 1/2003 | Daudi et al. |
| 6,507,716 | B2 | 1/2003 | Nomura et al. |
| 6,543,518 | B1 | 4/2003 | Bend et al. |
| 6,648,055 | B1 | 11/2003 | Haug et al. |
| 6,799,664 | B1 | 10/2004 | Connolly |
| 6,880,681 | B2 | 4/2005 | Koizumi et al. |
| 6,890,218 | B2 | 5/2005 | Patwardhan et al. |
| 6,899,158 | B2 | 5/2005 | Matuura et al. |
| 6,932,917 | B2 | 8/2005 | Golden et al. |
| 6,945,309 | B2 | 9/2005 | Frait et al. |
| 7,066,235 | B2 | 6/2006 | Huang |
| 7,112,749 | B2 | 9/2006 | DiPaola et al. |
| 7,178,795 | B2 | 2/2007 | Huprikar et al. |
| 7,293,755 | B2 | 11/2007 | Miyahara et al. |
| 7,594,568 | B2 | 9/2009 | Hanna et al. |
| 7,604,098 | B2 | 10/2009 | Dessouki et al. |
| 7,644,750 | B2 | 1/2010 | Schroth et al. |
| 7,775,332 | B2 | 8/2010 | Hanna et al. |
| 7,823,763 | B2 | 11/2010 | Sachdev et al. |
| 7,836,938 | B2 | 11/2010 | Agarwal et al. |
| 7,937,819 | B2 | 5/2011 | Hanna et al. |
| 7,938,378 | B2 | 5/2011 | Hanna et al. |
| 2002/0084156 | A1 | 7/2002 | Ballinger et al. |
| 2002/0104721 | A1 | 8/2002 | Schaus et al. |
| 2003/0037999 | A1 | 2/2003 | Tanaka et al. |
| 2003/0127297 | A1 | 7/2003 | Smith et al. |
| 2003/0141154 | A1 | 7/2003 | Rancourt et al. |
| 2003/0213658 | A1 | 11/2003 | Baba |
| 2004/0031581 | A1 | 2/2004 | Herreid et al. |
| 2004/0045692 | A1 | 3/2004 | Redemske |
| 2004/0074712 | A1 | 4/2004 | Quaglia et al. |
| 2004/0084260 | A1 | 5/2004 | Hoyte et al. |
| 2004/0242363 | A1 | 12/2004 | Kohno et al. |
| 2005/0011628 | A1 | 1/2005 | Frait et al. |
| 2005/0150222 | A1 | 7/2005 | Kalish et al. |
| 2005/0183909 | A1 | 8/2005 | Rau, III et al. |
| 2005/0193976 | A1 | 9/2005 | Suzuki et al. |
| 2006/0076200 | A1 | 4/2006 | Dessouki et al. |
| 2006/0243547 | A1 | 11/2006 | Keller |
| 2007/0039710 | A1 | 2/2007 | Newcomb |
| 2007/0056815 | A1 | 3/2007 | Hanna et al. |
| 2007/0062664 | A1 | 3/2007 | Schroth et al. |
| 2007/0062768 | A1 | 3/2007 | Hanna et al. |
| 2007/0142149 | A1 | 6/2007 | Kleber |
| 2007/0166425 | A1 | 7/2007 | Utsugi |
| 2007/0235270 | A1 | 10/2007 | Miskinis et al. |
| 2007/0298275 | A1 | 12/2007 | Carter et al. |
| 2008/0099289 | A1 | 5/2008 | Hanna et al. |
| 2008/0185249 | A1 | 8/2008 | Schroth et al. |
| 2009/0032569 | A1 | 2/2009 | Sachdev et al. |
| 2009/0078515 | A1* | 3/2009 | Xia ..... 188/218 XL |
| 2009/0078520 | A1* | 3/2009 | Agarwal et al. ..... 188/381 |
| 2009/0107787 | A1 | 4/2009 | Walker et al. |
| 2009/0176122 | A1 | 7/2009 | Aase et al. |

FOREIGN PATENT DOCUMENTS

| | | | |
|---|---|---|---|
| CN | 1757948 | A | 4/2006 |
| CN | 2863313 | Y | 1/2007 |
| DE | 2446938 | A1 | 4/1976 |
| DE | 2458335 | A1 | 6/1976 |
| DE | 2537038 | A1 | 3/1977 |
| DE | 19649919 | A1 | 6/1998 |
| DE | 19948009 | C1 | 3/2001 |
| DE | 60000008 | T2 | 3/2002 |
| DE | 10141698 | A1 | 3/2003 |
| DE | 102005048258 | A1 | 4/2006 |
| DE | 60116780 | T2 | 11/2006 |
| DE | 102005051092 | B3 | 3/2007 |
| DE | 102006034341 | A1 | 1/2008 |
| DE | 102008037635 | A1 | 5/2009 |
| EP | 0205713 | A1 | 12/1986 |
| GB | 1230274 | | 4/1971 |
| GB | 2328952 | A | 3/1991 |
| JP | 57154533 | A | 9/1982 |
| JP | 1126434 | U1 | 8/1989 |
| JP | 05-104567 | | 4/1993 |
| JP | 11342461 | A | 12/1999 |
| JP | 2001512763 | T | 8/2001 |
| JP | 2003214465 | A | 7/2003 |
| JP | 2004011841 | A | 1/2004 |
| KR | 20010049837 | A | 6/2001 |
| WO | 9823877 | A1 | 6/1998 |
| WO | 0136836 | A1 | 5/2001 |
| WO | 2007035206 | A2 | 3/2007 |
| WO | 2009042353 | A1 | 4/2009 |

OTHER PUBLICATIONS

Anyalebechi, P.N.; "Ungrooved Mold Surface Topograpy Effects on Cast Subsurface Microstructure"; Materials Processing Fundamentals, TMS, 2007, pp. 49-67.

Dessouki et al. Disc Brake Squeal: Diagnosis and Prevention; Society of Automotive Engineers, 2002, 7 pages.

Hector et al., "Focused Energy Beam Work Roll Surface Texturing Science and Technology"; Journal of Material Processing & Manufacturing Science, vol. 2, Jul. 1993; pp. 63-119.

Lee et al., "Titanium Dioxide Nanotube Arrays Fabricated by Anodizing Processes"; Journal of the Electrochemical Society, 153 (11) 2006, pp. 499-505.

Sieber et al., "Porous Tantalum Oxide Prepared by Electrochemical Anodic Oxidation"; Journal of the Electrochemical Society, 152 (9) 2005, pp. 639-644.

Tanaka et al., In situ Measurement of the Diameter of Nanopores in Silicon during Anodization in Hydrofluoric Acid Solution; Journal of the Electrochemical Society; 151 (6) 2004, pp. 439-445.

(56) References Cited

OTHER PUBLICATIONS

Yigit et al., "Critical Wavelengths for Gap Nucleation in Solidification—Part I: Theoretical Methodology"; ASME, vol. 67, Mar. 2000, pp. 66-77.
U.S. Appl. No. 10/961,813, filed Oct. 8, 2004; Inventor: Omar S. Dessouki.
U.S. Appl. No. 11/554,234, filed Oct. 30, 2006; Inventor: Michael D. Hanna.
U.S. Appl. No. 11/680,179, filed Feb. 28, 2007; Inventor: Jon T. Carter.
U.S. Appl. No. 11/780,679, filed Jul. 20, 2007; Inventor: Michael D. Hanna.
U.S. Appl. No. 11/848,732, filed Aug. 31, 2007; Inventor: Richard M. Kieber.
U.S. Appl. No. 11/858,596, filed Sep. 20, 2007; Inventor: Houchun Xia.
U.S. Appl. No. 11/926,798, filed Oct. 29, 2007; Inventor: Michael J. Walker.
U.S. Appl. No. 11/969,259, filed Jan. 1, 2008; Inventor: Jan H. Aase.
U.S. Appl. No. 12/025,967, filed Feb. 5, 2008; Inventor: James G. Schroth.
U.S. Appl. No. 12/105,411, filed Apr. 18, 2008; Inventor: Mark A. Golden.
U.S. Appl. No. 12/105,438, filed Apr. 18, 2008; Inventor: John C. Ulicny.
U.S. Appl. No. 12/165,729, filed Jul. 1, 2008; Inventor: Michael D. Hanna.
U.S. Appl. No. 12/165,731, filed Jul. 1, 2008; Inventor: Michael D. Hanna.
U.S. Appl. No. 12/174,163, filed Jul. 16, 2008; Inventor: Michael D. Hanna.
U.S. Appl. No. 12/174,223, filed Jul. 16, 2008; Inventor: Michael D. Hanna.
U.S. Appl. No. 12/174,320, filed Jul. 16, 2008; Inventor: Brent D. Lowe.
U.S. Appl. No. 12/183,104, filed Jul. 31, 2008; Inventor: Michael D. Hanna.
U.S. Appl. No. 12/183,180, filed Jul. 31, 2008; Inventor: Michael D. Hanna.
U.S. Appl. No. 12/187,872, filed Aug. 7, 2008; Inventor: Kenichi Kimura.
U.S. Appl. No. 12/272,164, filed Nov. 17, 2008; Inventor: Michael D. Hanna.
Chinese First Office Action; CN200510113784.X; Dated May 18, 2007; 19 pages.
Chinese Second Office Action; CN200510113784,X; Dated Feb. 15, 2008; 13 pages.
German Examination Report; DE102005048258.9-12; Dated Oct. 22, 2007; 8 pages.
Gerdemann, Steven J,; Titanium Process Technologies; Advanced Materials & Processes, Jul. 2001, pp. 41-43.
Mahoney, M. W. & Lynch S. P.; Friction-Stir Processing; 15 pages, 2006.
MPIF: All You Need to Know about Powder Metallurgy; http://www.mpif.org/IntroPM/intropm/asp?linkid=1; 8 pages, print date Jun. 23, 2008.
Powder Metallurgy—Wikipedia article; http://en.wikipedia.org/wiki/Powder_metallurgy; 5 pages, print date Jun. 19, 2008.
Sintering—Wikipedia article; http://en.wikipedia.org/wiki/Sintering; 2 pages, print date Jun. 19, 2008.
Magnetorheological fluid—Wikipedia article; http:en/wikipedia.org/wiki/Magnetorheological_fluid, 6 pages, print date Nov. 6, 2007.
PCT/US2008/087354 Written Opinion and Search Report; Date of Mailing: Aug. 3, 2009; 9 pages.
PCT/US2009/039839 Written Opinion and Search Report; Date of Mailing: Nov. 24, 2009; 7 pages.
PCT/US2009/048424 Written Opinion and Search Report; Date of Mailing; Dec. 28, 2009; 7 pages.
U.S. Appl. No. 12/328,989, filed Dec. 5, 2008; First Named Inventor: Patrick J. Monsere.
U.S. Appl. No. 12/420,259, filed Apr. 8, 2009; First Named Inventor: Michael D. Hanna.
U.S. Appl. No. 12/434,057, filed May 1, 2009; First Named Inventor: Chongmin Kim.
U.S. Appl. No. 12/436,830, filed May 7, 2009; First Named Inventor: James G. Schroth.
U.S. Appl. No. 12/489,901, filed Jun. 23, 2009; First Named Inventor: Michael D. Hanna.
U.S. Appl. No. 12/885,813, filed Sep. 20, 2010; First Named Inventor: Michael D. Hanna.
PCT/US2006/029687 Search Report and Written Opinion; PCT/ISA/210 & PCT/ISA/237; Mailed Apr. 2, 2007; 6 pages.
Wu et al., "A Study of Anodization Process During Pore Formation in Nanoporous Alumina Templates", Journal of Electrochemical Society; 154 (1) 2007, pp. 8-12.
German Office Action dated Sep. 14, 2012; Application SN:102011112176.9; Applicant GM Global Technology Operations LLC; 4 pages.
Chinese Office Action dated Jul. 1, 2013; Applicant: GM Global Technology Operations LLC; Application No. 2011102793733; 9 pages.

* cited by examiner

METHOD OF MAKING A BRAKE COMPONENT

TECHNICAL FIELD

The technical field of this disclosure generally relates to methods of making brake components for use in motor vehicle applications.

BACKGROUND

Motor vehicle brake components are commonly subjected to vibrations during the course of normal operation. Among other potential adverse affects, these vibrations may result in noise that gets transmitted into the vehicle's passenger compartment and beyond. For example, while braking, the occurrence of both low and high frequency vibrations in one or more brake components oftentimes results in a particular noise that is heard and felt by a driver.

One way to minimize these vibrations, and thus unwanted noise, is to friction damp a vehicle's brake components with a mechanism that utilizes friction to absorb and dissipate mechanical energy associated with the vibrations. To this end, a wide range of friction damping means have been developed for disposition into various parts of a brake component during the manufacturing stage. Such means ultimately contribute to friction damping by providing a surface that can frictionally interact with an adjacent contacting surface of the brake component.

During product production, however, the disposition of the friction damping means into a vehicle brake component can oftentimes be a tricky procedure. Efforts are thus continually being made to simplify, expedite, and improve such procedures.

SUMMARY OF EXEMPLARY EMBODIMENTS OF THE INVENTION

One embodiment may include a method that calls for supporting an insert in a mold cavity by way of one or more spacers and introducing a molten material into the mold cavity. The one or more spacers and the molten material may be of the same composition.

Another embodiment may include a method that calls for providing a casting die having a mold cavity shaped for casting a brake component. The method may further include supporting at least one insert in the mold cavity with one or more spacers of a first composition. The method may additionally include casting a brake component in the mold cavity using a molten material of the first composition.

Yet another embodiment may include a method that calls for providing a sand casting die having a mold cavity shaped for casting a brake component. The method may further include supporting at least one insert in a predetermined relationship to the mold cavity by way of one or more spacers comprising a first composition. The method may additionally include introducing a molten material comprising the first composition into the mold cavity. The method may also include gradually melting the one or more spacers in the molten material and solidifying the molten material around the insert and into a brake component of a uniform composition.

Other exemplary embodiments of the invention will become apparent from the detailed description provided hereafter. It should be understood that the detailed description and specific examples, while disclosing exemplary embodiments of the invention, are intended for purposes of illustration only and are not intended to limit the scope of the invention.

BRIEF DESCRIPTION OF THE DRAWINGS

Exemplary embodiments of the invention will become more fully understood from the detailed description and the accompanying drawings, wherein.

DETAILED DESCRIPTION OF EXEMPLARY EMBODIMENTS

The following description of the embodiment(s) is merely exemplary in nature and is in no way intended to limit the invention, its application, or uses.

Figure 1:
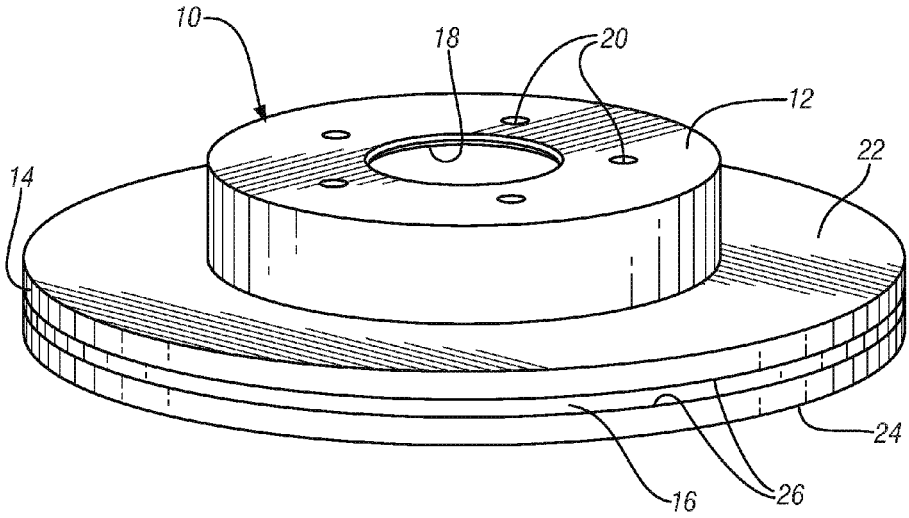
FIG. 1 is a perspective view of a brake component in accordance with one embodiment of the invention
Figure 2:
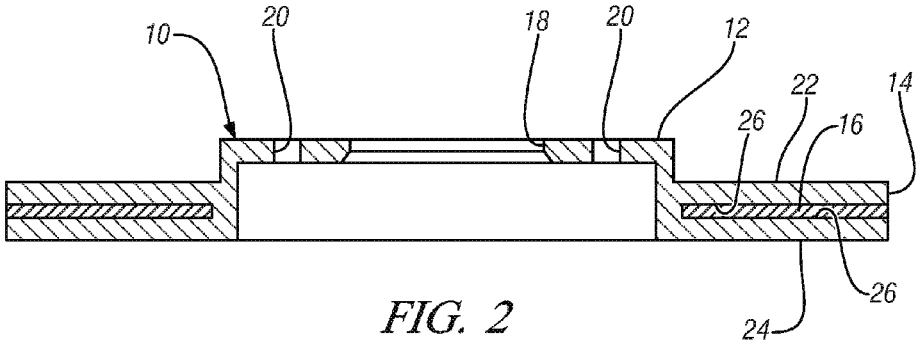
FIG. 2 is a cross-sectional view of the brake component of FIG. 1.
Figure 3:
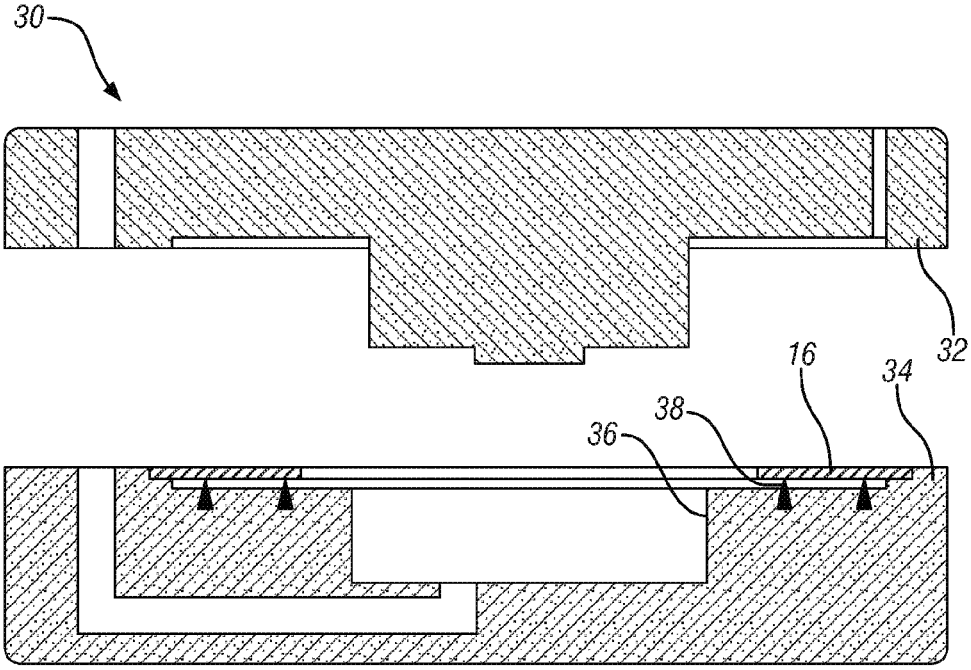
FIG. 3 is a cross-sectional view of a casting die in an open position with at least one insert positioned in a mold cavity of the die according to one embodiment of the invention.
Figure 4:
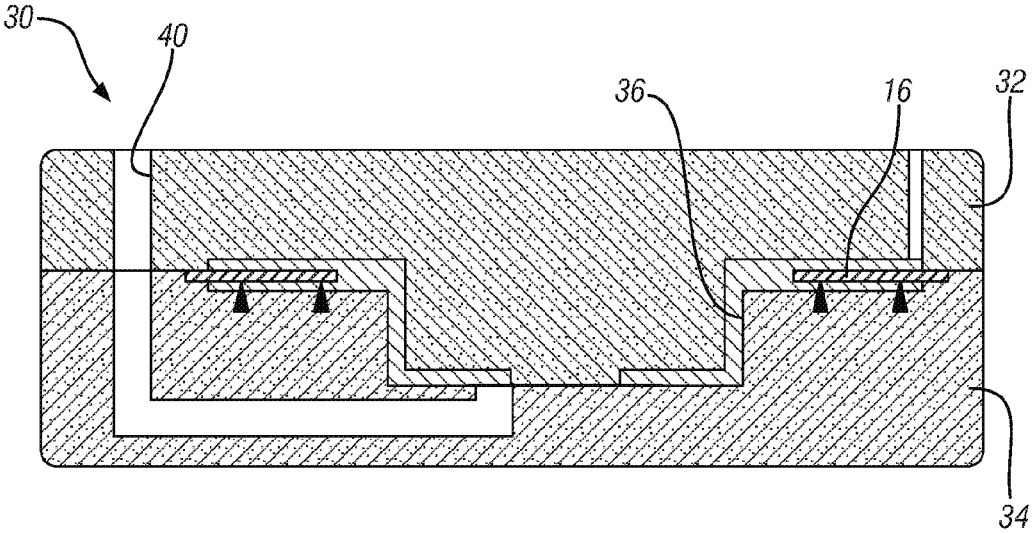
FIG. 4 is a cross-sectional view of a casting die in a closed position after the introduction of a molten material into a mold cavity of the die.
Figure 5:
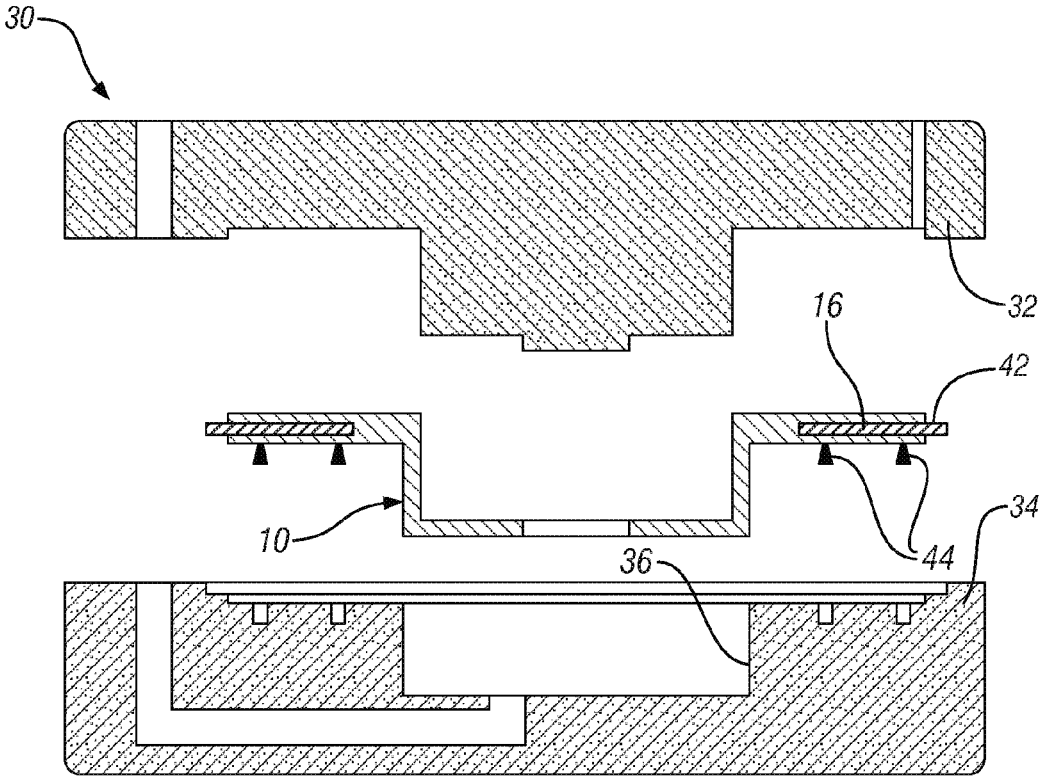
FIG. 5 is a cross-sectional view of a casting die in an open position with a brake component removed therefrom, according to one embodiment of the invention.

Referring now to the drawings, FIGS. 1-5 show a brake component with a friction damping means disposed therein (FIGS. 1-2) and a schematic illustration of a casting die for forming the brake component by casting (FIGS. 3-5). As part of casting, a molten material that is to become the brake component may be introduced into a mold cavity of the casting die and around the friction damping means. The friction damping means may be supported in place by one or more spacers. Additionally, the one or more spacers may be of the same composition as the molten material. The molten material and the one or more spacers are considered to be the same material regardless of slight deviations in composition and/or the presence of impurities, both of which are often attributable to the nature of metal processing, so long as skilled artisans would identify them as the same for all practical purposes. In this regard, the molten material can melt and consume the one or more spacers and solidify into a brake component of a uniform composition. More specifically, as an exemplary embodiment, FIGS. 1-5 are directed towards a disc brake rotor 10 that includes an insert 16 for friction damping the rotor 10. But while a disc brake rotor 10 is shown and described in the drawings, it should be understood that the methods described herein may be easily practiced in accordance with the forming of other brake components such as a brake drum or any other cast part.

Referring now to FIG. 1, there is generally shown for illustrative purposes a disc brake rotor 10 for use in motor vehicle braking applications. Typically, the disc brake rotor 10 is mounted to the vehicle so that it can co-rotate in unison with a vehicle wheel (not shown). A driver of the vehicle can controllably stop or slow rotation of the wheel by initiating frictional contact between the disc brake rotor 10 and a brake element (not shown), usually by depressing a foot brake located underneath the steering column. The disc brake rotor 10 may be formed from any suitable material known to skilled artisans such as, but not limited to, cast iron, gray cast iron, titanium, aluminum, steel, stainless steel, a suitable alloy, or a metal matrix composite. As shown, the disc brake rotor 10 includes a rotor hat 12 and a rotor cheek 14.

The rotor hat 12 connects the rotor 10 to an axle hub (not shown) of a rotatable axle. As shown, the rotor hat 12 may be a centrally protruding portion of the disc brake rotor 10 and may include, among other features, an axle bore 18 and a plurality of bolt holes 20. The axle bore 18 receives the axle therethrough so that the axle, the axle hub, and the rotor hat 12 may be fastened together by way of the plurality of bolt holes 20, as is well known in the art.

The rotor cheek 14 provides at least one interface for experiencing selective frictional contact with the braking element such as a brake pad carried on a brake caliper. As shown, the rotor cheek 14 extends radially from and annularly around the rotor hat 12 and includes a pair of oppositely facing braking surfaces 22, 24. Although not shown here, the rotor cheek 14 may include a web of ventilation vanes between the braking surfaces 22, 24 for expelling heat from the rotor cheek 14.

The insert 16, as alluded to above, friction damps the disc brake rotor 10 by frictionally interacting with a surface 26 of the rotor cheek 14 in response to vibrations imparted thereto. The insert 16 may be constructed to friction damp the disc brake rotor 10 in a number of fashions such as, for example, those described in U.S. patent application Ser. No. 11/780,828, which is commonly assigned to the assignee of this disclosure. As shown in the drawings, the insert 16 may be disposed inside the rotor cheek 14 and at least partially encased therein. The insert 16 may further be a one-piece part that substantially coincides with the annular and radial dimensions of the rotor cheek 14, as best shown in FIG. 2. The insert 16 may be constructed from a variety of materials such as, but not limited to, a low carbon mild steel such as AISI 1010 steel and AISI 1008 steel, an aluminum-steel composite, cast iron, grey cast iron, a ferrous-manganese alloy, a metal matrix composites, ductile iron, and stainless steel. But the insert 16, or inserts as the case may be, is not necessarily limited to the particular shapes, configurations, dimensions, or arrangement shown in the FIGS. 1 and 2. To cite but one example, a plurality of arcuate inserts may be annularly aligned in an end-to-end relationship inside the rotor cheek 14 to closely resemble the one-piece insert 16 described above. The disc brake rotor 10 may also include multiple one-piece inserts that are axially spaced from one another when, for example, a web of ventilation vanes divides the rotor cheek 14 into two similar portions that each have an insert disposed therein.

The disc brake rotor 10 may formed by casting. Casting, as used herein, includes introducing a molten or liquid material into a mold cavity and solidifying it therein. The molten or liquid material may be of any composition that, upon solidifying, renders the disc brake rotor 10 suitable for its intended use. Such compositions are generally known to skilled artisans and include those mentioned above. The casting of the disc brake rotor 10 may be accomplished by any type or style known to skilled artisans; the selection of which normally depends on various factors including, among others, the particular material to be cast and the size and complexity of the shape of the mold cavity. Furthermore, the casting of the disc brake rotor 10 may be part of a multi-stage manufacturing process in which the brake disc rotor 10 undergoes subsequent refinishing or machining, or it may be a stand-alone process in which the rotor 10 derived therefrom is a substantially finished product. An exemplary embodiment for casting the disc brake rotor 10 around the insert 16 will now be described with reference to FIGS. 3-5.

Referring now to FIG. 3, there is illustratively shown for exemplary purposes only a sand casting die 30 for use in sand casting the disc brake rotor 10 from molten cast iron. The sand casting die 30 may include an upper die member 32 and a lower die member 34 that, when closed, define a mold cavity 36 which represents the desired size and shape of the disc brake rotor 10. Both the upper die member 32 and the lower die member 34 may be constructed from packed sand that is bonded together by clays, chemical binders, or oils, to name but a few. Furthermore, as shown here, the sand casting die 30 may be oriented to accommodate horizontal casting. Or, if desired, vertical casting may be implemented. In any event, skilled artisans will know and understand the general construction and arrangement of the sand casting die 30, as well as the many variations that can be employed, such that a more complete description need not be given here.

As best shown in FIG. 3, the upper die member 32 and the lower die member 34 may be separated to make the mold cavity 36 accessible. The insert 16 may then be supported in the mold cavity by way of one or more spacers 38, also commonly referred to as chaplets, which are shown here as being carried by the lower die member 34. Indeed, as shown in FIG. 3, the one or more spacers 38 may be pre-arranged and imbedded in the lower die member 34. Imbedding of the one or more spacers 38 can be accomplished during construction of the lower die member 34 by known techniques. The one or more spacers 38 may function to hold or support the insert 16 in place while maintaining a desirable spatial relationship and alignment with respect to the mold cavity 36. In this regard, the one or more spacers 38 may be carefully crafted to tight tolerances by casting or machining to help ensure the insert 16 is properly located as intended in the mold cavity 36. For instance, in one exemplary embodiment, and as depicted in FIG. 3 and more clearly in FIG. 4, the one or more spacers 38 may be crafted to support the insert 16 in the mold cavity 36 so that the insert 16 is approximately equidistant from the portions of the upper die member 32 and the lower die member 34 which define the rotor cheek 14 of the disc brake rotor 10. Moreover, as shown in this embodiment, the one or more spacers 38 may generally be in the shape of spikes, although such a construction is not necessary. For reasons that will be clarified below, the one or more spacers 38 may be of the same composition as the molten material that eventually solidifies to become the disc brake rotor 10, which in this particular embodiment happens to be cast iron.

After the insert 16 is supported by the one or more spacers 38, the upper die member 32 and the lower die member 34 may be brought together to close the sand casting die 30 as shown in FIG. 4. Next, in one exemplary embodiment, a charge of molten cast iron may be introduced into the mold cavity 36 through an inlet 40. While the inlet 40 is shown here in the upper die mold 32, skilled artisans will appreciate that the molten cast iron can be introduced into the mold cavity 36 in a multitude of fashions that are not shown or described in the drawings. Once introduced, the molten cast iron floods the mold cavity 36 and accumulates around any portion of the insert 16 and the one or more spacers 38 present therein. It should be noted that a surface coating composed of, but not limited to, a graphite-based material and/or a refractory-based material may be applied to the insert 16 to protect it from interacting with the molten cast iron in a manner that may adversely impact its friction damping characteristics. One specific example of such a coating material is IRONKOTE, which is available from Vesuvius Canada Refractories, Inc., of Welland, Ontario. IRONKOTE is composed of alumina particles (about 47.5%) and silicate particles (about 39.8%) dispersed in a lignosulfonate binder.

While the thickness of the applied coating may vary depending on, among others, the compositional makeup of the coating and the environment to which the coating may be exposed, it usually ranges from is about 1 μm to about 500 μm.

As mentioned before, the molten cast iron introduced into the mold cavity 36 may be of the same composition as the one or more spacers 38 that support the insert 16. In this regard, the molten cast iron can gradually melt and ultimately consume the one or more spacers 38 without affecting its compositional integrity. That is, the one or more spacers 38, upon melting, become indistinguishly intermixed or fused with the molten cast iron as it settles in the mold cavity 36. The melting and consumption of the one or more spacers 38 has little effect on the spacing and alignment of the insert 16 with respect to the mold cavity 36. This is because the one or more spacers 38 can substantially retain their structural rigidity and hence their load bearing capacity when the molten material is first introduced into the mold cavity 36. And, not long thereafter, as the one or more spacers 38 are melting or starting to melt, the molten material will begin to settle and take shape in the mold cavity 36 around the insert 16 in a manner that more than adequately compensates for any loss of support due to the melting of the one or more spacers 38.

The molten cast iron is then allowed to solidify in the mold cavity 36 and around the insert 16 to form the disc brake rotor 10. At least a portion of the one or more spacers 38 have now become part of the disc brake rotor 10, more specifically the rotor cheek 14 as shown in the drawings, without promoting any significant compositional discontinuity therein. That is, the rotor cheek 14 of the disc brake rotor 10 exhibits a substantially uniform compositional profile that is free from regions or localized zones of significant compositional dissimilarities as a result of using the one or more spacers 38 in supporting the insert 16. Such a characteristic may be helpful in improving the performance and preserving the disc brake rotor 10 when used in motor vehicle braking applications. For example, some of the adverse affects relating to brake rotor 10 operation that can be reduced or altogether eliminated include those associated with differing frictional coefficients along the braking surfaces 22, 24 of the rotor cheek 14, the occurrence of localized corrosion, the presence of regions that experience different rates of thermal expansion, the possibility of accelerated wear of the rotor cheek 14 and the brake element, and noise generation.

After the molten cast iron solidifies, the disc brake rotor 10 with the insert 16 disposed therein may be removed from the mold cavity 36, as illustratively shown in FIG. 5. In this particular embodiment, the upper die member 32 and the lower die member 34 may be separated to the extent possible since the die members 32, 34 are constructed from packed sand. Any residual sand or chunks of sand may then be brushed or swept away to disencumber the brake disc rotor 10. The brake disc rotor 10 may now undergo any subsequent refinishing or machining deemed necessary, such as cutting off an exposed portion 42 of the insert 16 to make if flush with the edge of the rotor cheek 12 and/or removing any imperfections, such as bulges or protrusions. Any remnants 44 attributable to the one or more spacers 38 may also be removed by known machining techniques or other appropriate procedures as well.

Figure 6:
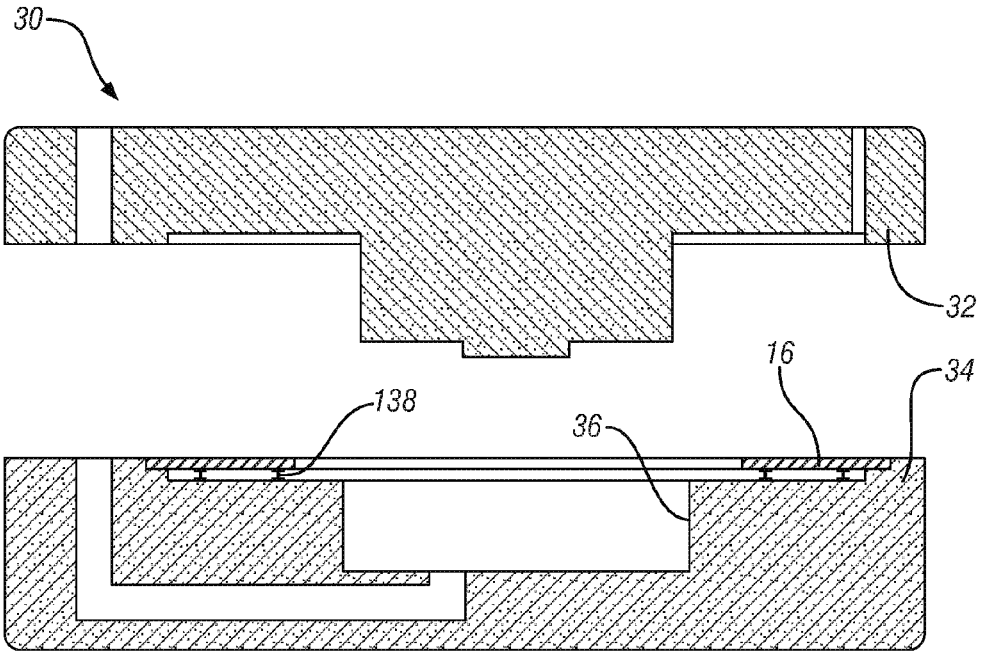
FIG. 6 is a cross-sectional view of a casting die in an open position with at least one insert positioned in a mold cavity of the die according to one embodiment of the invention.

Referring now to FIG. 6, there is shown an alternative exemplary embodiment for sand casting the disc brake rotor 10. This embodiment is similar in many respects to the embodiment shown in FIGS. 3-5 and, as such, those similarities will not be repeated here. At least one difference in this embodiment is the shape of the one or more spacers 138 for supporting the one or more inserts 16 in the mold cavity 36 of a sand casting die 30. As shown, among many other possible variations, the one or more spacers 138 may be I-shaped. At least one other difference is that, after the sand casting die 30 is constructed, the one or more spacers 138 may be positioned in and around the mold cavity 36 in a random pattern or in conjunction with pre-formed indentations or locator marks. This technique may be useful if embedding the one or more spacers 138 in the sand casting die 30 is undesirable for whatever reason.

Although not particularly shown or described, other alternative exemplary embodiments for casting a brake component include the use of die casting. Die casting, much like the various sand casting embodiments described above, is generally known and understood in the art and typically includes the use of an upper die member and a lower die member each constructed from a metal such as steel. Die casting may be utilized, for example, when a molten material used to cast the brake component is aluminum, zinc, or a related alloy. Moreover, other alternative exemplary embodiments not particularly shown or described include those which substitute or combine subject matter from the various exemplary embodiments discussed above.

The above description of embodiments of the invention is merely exemplary in nature and, thus, variations thereof are not to be regarded as a departure from the spirit and scope of the invention.

What is claimed is:

1. A method comprising:

providing a casting die including an upper die member and a lower die member each constructed and arranged such that, when closed, define the mold cavity;

supporting at least one insert in the mold cavity by way of one or more spacers, the one or more spacers being carried by the lower die member and being constructed and arranged to support the at least one insert;

wherein the shape and size of the at least one insert substantially coincides with annular and radial dimensions of the mold cavity;

closing the upper die member and lower die member together to close the at least one insert and one or more spacers within the mold cavity; and introducing a molten material into the mold cavity such that the one or more spacers are melted and consumed by the molten material;

wherein the one or more spacers and the molten material are of the same composition.

2. The method of claim 1, wherein supporting an insert comprises supporting the insert with a plurality of spacers each constructed from cast iron, and wherein introducing a molten material comprises introducing molten cast iron into the mold cavity.

3. The method of claim 1, wherein supporting an insert comprises supporting the insert with a plurality of spacers that are imbedded in the casting die.

4. The method of claim 1, wherein the mold cavity is shaped to form a brake component.

5. The method of claim 4, wherein the mold cavity shaped to form a disc brake rotor.

6. The method of claim 1, wherein the casting die is constructed from packed sand.

7. The method of claim 1, further comprising solidifying the molten material in the mold cavity and around the insert.

8. The method of claim 1 further comprising solidifying the molten material to provide a product and wherein the insert has a coating thereon to protect the insert from interacting with the molten material and so that the insert friction damps the product.

9. The method of claim 1 wherein the insert is annular shaped or comprises a plurality of arch shaped segments.

10. The method as set forth in claim 1 wherein the spacers have at least one of a spike of I shape.

11. The method as set forth in claim 1 wherein the mold cavity is defined by an upper die member and a lower die member, wherein the upper die member and the lower die member also define the rotor cheek of a disc rotor, and wherein the insert, spacers and the upper die member and the lower die member are constructed and arranged so that the insert is approximately equidistant from a portion of the upper die member and the lower die member defining the rotor cheek.

12. A method comprising:

providing a casting die having a mold cavity shaped for casting a brake component, wherein the casting die includes an upper die member and a lower die member each constructed from packed sand and that, when closed, define the mold cavity, and one or more spacers of a first composition imbedded in either of the upper die member or the lower die member of the casting die;

providing at least one insert the at least one insert individually having an arcurate shape and size that substantially coincides with annular and radial dimensions of the mold cavity and being annularly aligned and axially spaced in an end-to-end relationship within the mold cavity;

thereafter supporting the at least one insert in the mold cavity with one or more spacers of a first composition; and casting a brake component in the mold cavity around the at least one insert using a molten material of the first composition.

13. The method of claim 12, wherein the casting a brake component in the mold cavity around the at least one insert using a molten material of the first composition is conducted so that the one or more spacers are melted and consumed by the molten material.

14. The method of claim 13, wherein the casting a brake component in the mold cavity around the at least one insert using a molten material of the first composition is conducted so that the insert is at least partially encased by the molten material.

15. The method of claim 12, wherein the one or more spacers of a first composition comprise a plurality of spacers each constructed from cast iron.

16. The method of claim 12, wherein the mold cavity is shaped to define a disc brake rotor.

17. The method of claim 12, wherein the casting results in the one or more spacers of a first composition being melted and consumed by the molten material of the first composition.

18. The method of claim 12 wherein the insert has a coating thereon to protect the insert from interacting with the molten material and so that the insert friction damps the brake rotor component.

19. The method as set forth in claim 12 wherein the mold cavity is shaped to define a disc brake rotor, wherein the casting results in the one or more spacers of a first composition being melted and consumed by the molten material of the first composition, and wherein the insert is annular shaped or comprises a plurality of arch shaped segments.

20. The method as set forth in claim 19 wherein the spacers have at least one of a spike of I shape.

21. A method comprising:

providing a sand casting die that includes an upper die member and a lower die member that, when closed, define a mold cavity shaped for casting a brake component comprising a rotor hat portion and a rotor hub portion; and wherein the upper die member defines a first rotor hat portion and a first rotor hub portion and wherein the lower die member defines a second rotor hat portion and a second rotor hub portion;

supporting at least one insert in a predetermined relationship to the mold cavity by way of one or more spacers comprising a first composition;

wherein the predetermined relationship causes the at least one insert to be at least partially encased in the mold cavity and to occupy a portion of the first and second rotor hub portions defined by the upper die member and the lower die member;

introducing a molten material comprising the first composition into the mold cavity;

melting and consuming gradually the one or more spacers in the molten material while maintaining the predetermined relationship between the at least one insert and the mold cavity.

22. The method of claim 21, wherein the mold cavity is shaped for casting a disc brake rotor that includes a rotor hat and a rotor cheek.

23. The method of claim 22, wherein solidifying the molten material is conducted so that the at least one insert is disposed in the rotor cheek.

24. The method of claim 22, wherein the predetermined relationship is equidistant from the portions of the upper die member and the lower die member which define the rotor cheek of the disc brake rotor.

25. The method as set forth in claim 24 wherein the insert, spacers and the upper die member and the lower die member are constructed and arranged so that the insert is approximately equidistant from a portion of the upper die member and the lower die member defining the rotor cheek.

26. The method of claim 21, wherein the at least one spacer comprises a plurality of spacers each composed of cast iron, and wherein the molten material introduced into the mold cavity is molten cast iron.

27. The method of claim 21, wherein supporting the at least one insert comprises imbedding the one or more spacers in either the upper die member or the lower die member.

28. The method of claim 21 farther comprising solidifying the molten material so that the insert is at least partially encased by the molten material.

29. The method of claim 21 further comprising solidifying the molten material so that the insert is encased by the molten material.

30. The method of claim 21 further comprising solidifying the molten material to provide a product and wherein the insert has a coating thereon to protect the insert from interacting with the molten material and so that the insert friction damps the product.

31. The method as set forth in claim 21 wherein the insert is annular shaped or comprises a plurality of arch shaped segments.

32. The method as set forth in claim 21 wherein the spacers have at least one of a spike of I shape.

* * * * *